US006057517A

United States Patent [19]

Meyer

[11] Patent Number: 6,057,517

[45] Date of Patent: May 2, 2000

[54] ELASTOMERIC KEYBOARD INCORPORATING A NOVEL INTERCONNECT AND BACK-LIGHTING ARCHITECTURE

[75] Inventor: Steven H. Meyer, Buda, Tex.

[73] Assignee: Texas Industrial Peripherals, Austin, Tex.

[21] Appl. No.: 09/256,266

[22] Filed: Feb. 23, 1999

[51] Int. Cl.[7] ..... H01H 9/26

[52] U.S. Cl. ..... 200/5 A; 200/1 TK

[58] Field of Search ..... 200/1 TK, 268, 200/269, 292, 5 A

[56] References Cited

U.S. PATENT DOCUMENTS

| | | | |
|---|---|---|---|
| 4,314,117 | 2/1982 | Ditzig | 200/5 A |
| 5,138,119 | 8/1992 | Demeo | 200/5 A |
| 5,777,281 | 7/1998 | Riddiford | 200/5 A |
| 5,847,336 | 12/1998 | Thornton | 200/5 A |

*Primary Examiner*—Michael L. Gellner
*Assistant Examiner*—Nhung Nguyen
*Attorney, Agent, or Firm*—Gray Cary Ware & Freidenrich, LLP

[57] ABSTRACT

The elastomeric keyboard incorporating a novel interconnect and back-lighting architecture of the present invention includes a printed circuit board and a novel multi-layer membrane switch matrix interconnect structure. The printed circuit board contains a control circuit for powering and controlling the back-lighting of the elastomeric keyboard. The electrical components which make up the control circuit are mounted on a top side of the printed circuit board. The multi-layer switch matrix interconnect structure contains multiple holes arranged to coincide with the components of said control circuit. The multi-layer switch matrix interconnect structure also contains a number of electrical connectors, a number of conductive contacts, and a number of electrical nets for electrically connecting the conductive contacts to each other and to the electrical connectors.

17 Claims, 7 Drawing Sheets

ELASTOMERIC KEYBOARD INCORPORATING A NOVEL INTERCONNECT AND BACK-LIGHTING ARCHITECTURE

TECHNICAL FIELD OF THE INVENTION

This invention relates in general to electrical keyboards, and more particularly to an apparatus and method for manufacturing an elastomeric keyboard that fits within a standard notebook computer using a novel keyboard switch matrix interconnect structure together with a back-lighting architecture for illuminating the individual keys of the elastomeric keyboard.

BACKGROUND OF THE INVENTION

Elastomer style keyboards or keypads may be found today on devices such as telephones, alarm systems, or computers. Current elastomeric keyboards are comprised of a printed circuit board (PCB) and an elastomeric keypad overlay. Typically the PCB on existing elastomeric style keyboards contain a series of light emitting diodes (LEDs) and switch matrix circuitry on a top side of the PCB and control circuitry on a bottom side of the PCB.

Due to the current design of these conventional elastomeric keyboards, they do not fit properly within and may not be electrically connected to a standard notebook computer. Thus currently, there is no known elastomer style keyboard which may be placed in or electrically connected to a standard notebook computer that includes the combined features of large-conventional, low-cost interconnect devices, back-lighting for individual keys, and a single elastomeric overlay that covers the light sources as well as the interconnect devices.

SUMMARY OF THE INVENTION

The present invention provides an apparatus and method for manufacturing a keyboard apparatus.

More specifically, the present invention provides an apparatus and method for manufacturing an elastomeric keyboard that fits within a standard notebook computer using a novel keyboard switch matrix interconnect structure together with a back-lighting architecture for illuminating the individual keys of the elastomeric keyboard. The elastomeric keyboard incorporating a novel interconnect and back-lighting architecture of the present invention includes a printed circuit board and a novel multi-layer membrane switch matrix interconnect structure. The printed circuit board contains a control circuit for powering and controlling the back-lighting of the elastomeric keyboard. The electrical components which make up the control circuit are mounted on a top side of the printed circuit board. The multi-layer switch matrix interconnect structure contains multiple holes arranged to coincide with the components of said control circuit. The multi-layer switch matrix interconnect structure also contains a number of electrical connectors, a number of conductive contacts, and a number of electrical nets for electrically connecting the conductive contacts to each other and to the electrical connectors.

The present invention provides an important technical advantage by providing an elastomeric keyboard design that fits in a standard notebook computer which includes the combined features of a single elastomeric keyboard overlay, a control circuit with components on a top side of a printed circuit board for powering and controlling the back-lighting of the elastomeric keypad, and an economical, widely available novel interconnect scheme for communicating between the elastomeric keyboard and the computer.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DETAILED DESCRIPTION OF THE INVENTION

Preferred embodiments of the present invention are illustrated in the FIGURES, like numerals being used to refer to like and corresponding parts of the various drawings.

The elastomeric keyboard incorporating a novel interconnect and back-lighting architecture of the present invention includes a printed circuit board and a novel multi-layer membrane switch matrix interconnect structure. The printed circuit board contains a control circuit for powering and controlling the back-lighting of the elastomeric keyboard. The electrical components which make up the control circuit are mounted on a top side of the printed circuit board. The multi-layer switch matrix interconnect structure contains multiple holes arranged to coincide with the components of said control circuit. The multi-layer switch matrix interconnect structure also contains a number of electrical connectors, a number of conductive contacts, and a number of electrical nets for electrically connecting the conductive contacts to each other and to the electrical connectors.

Figure 1:
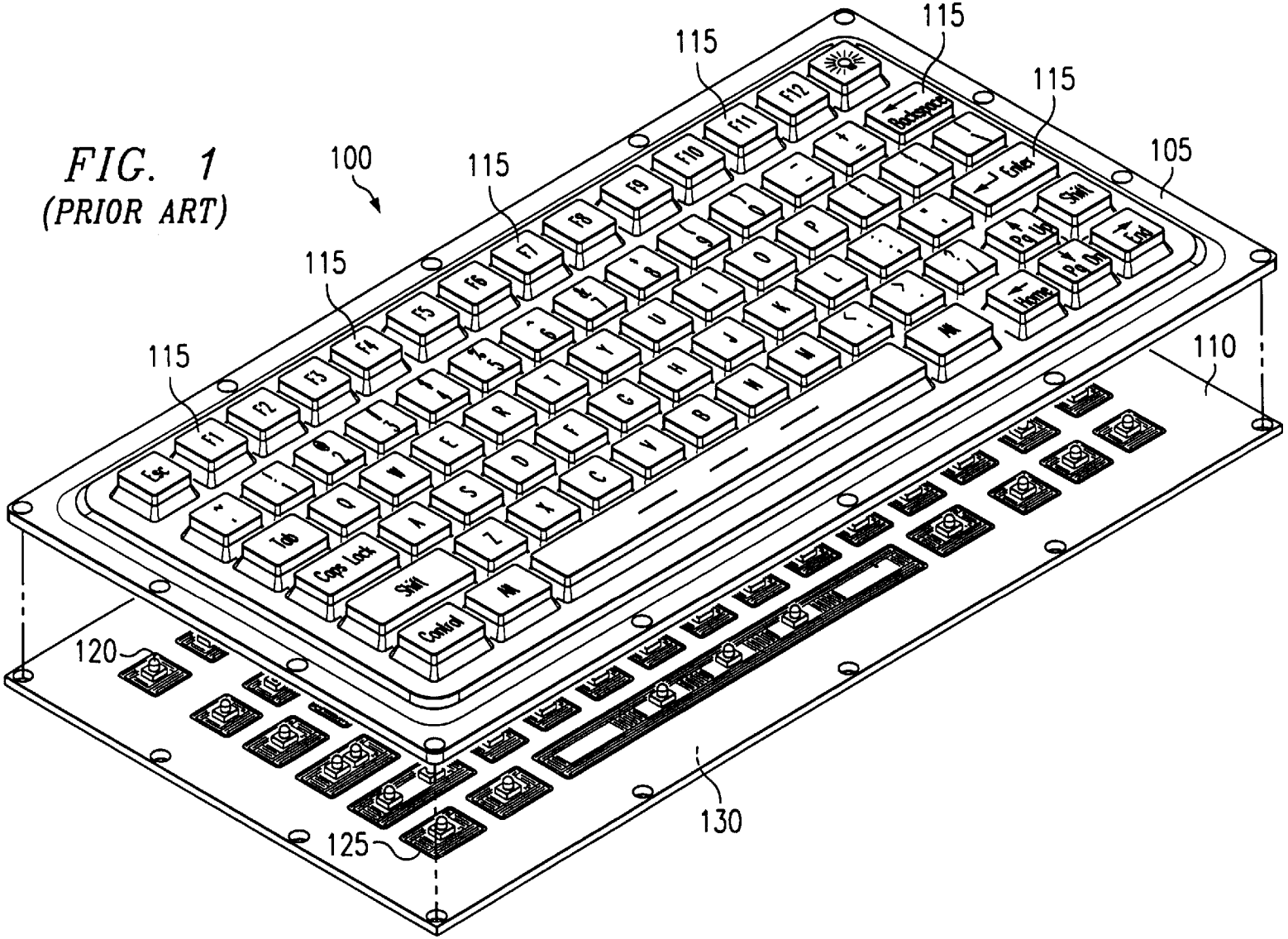
FIG. 1 (PRIOR ART)
FIG. 1 shows a diagram of a prior art elastomeric keyboard comprising a printed circuit board and an elastomeric keypad.

An embodiment depicting a prior art elastomeric keyboard apparatus 100 is shown in FIG. 1. The prior art elastomeric keyboard 100 is comprised of an elastomeric keypad 105 and a printed circuit board 110. The elastomeric keypad 105 has several keys 115. A top side of the printed circuit board 110 has several light emitting diodes 120, and several electrical contacts 125. One problem with the prior art elastomeric keyboard 100 is that the electrical components which control the lighting of the light emitting diodes are located on a bottom side 130 of the printed circuit board 110. Since the components are on the bottom side 130 of the printed circuit board 110, the elastomeric keyboard 100 may not be properly mounted in a computer or other standard computers. Another problem with the prior art elastomeric keyboard 100 is that it does not match the interconnect of the standard CPU type computer interconnection.

Figure 2:
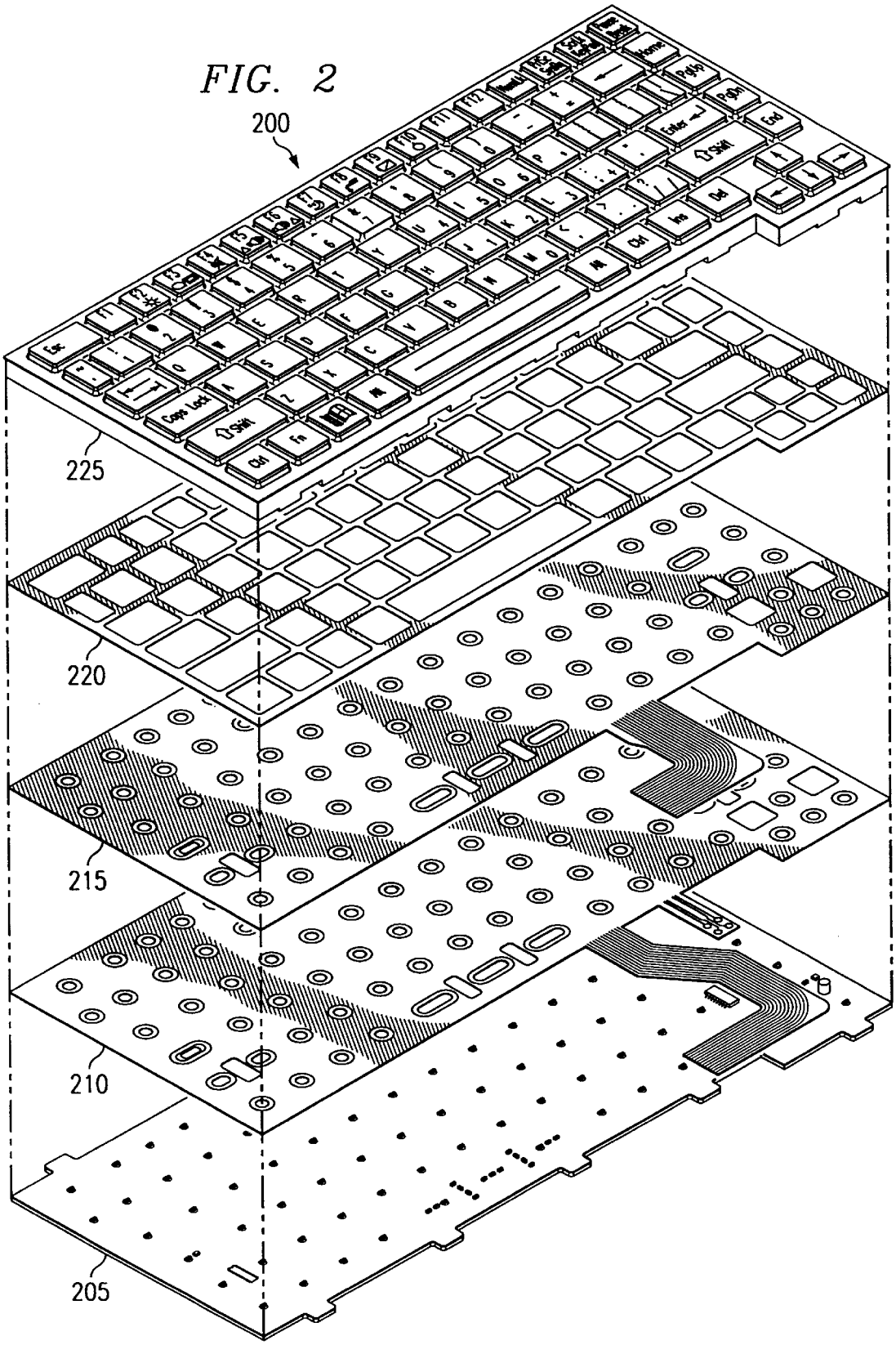
FIG. 2 shows an exploded view of one embodiment of the keyboard apparatus of the present invention comprising a printed circuit board, a first membrane switch matrix interconnect layer, a second membrane switch matrix interconnect layer, a spacer layer, and an elastomeric keypad.

One embodiment for the method and apparatus for manufacturing an elastomeric keyboard that fits within is a standard notebook computer using a novel keyboard switch matrix interconnect structure together with a back-lighting architecture for illuminating the individual keys of the elastomeric keyboard of the present invention is shown in FIG. 2. FIG. 2 shows an exploded view of the keyboard apparatus 200 including a printed circuit board 205, a second membrane switch matrix interconnect layer 210, a first membrane switch matrix interconnect layer 215, a spacer layer 220, and an elastomeric keypad 225.

As shown in FIG. 2, the keyboard apparatus 200 may be assembled by first mounting the second membrane switch matrix interconnect layer 210 on top of the printed circuit board 205. Next, the first membrane switch matrix interconnect layer 215 is mounted on top of the second membrane switch matrix interconnect layer 210. The spacer layer 220 is then mounted on top of the first membrane switch matrix interconnect layer 215. Finally, the elastomeric keypad 225 is mounted on top of the spacer layer 220.

Figure 3A:
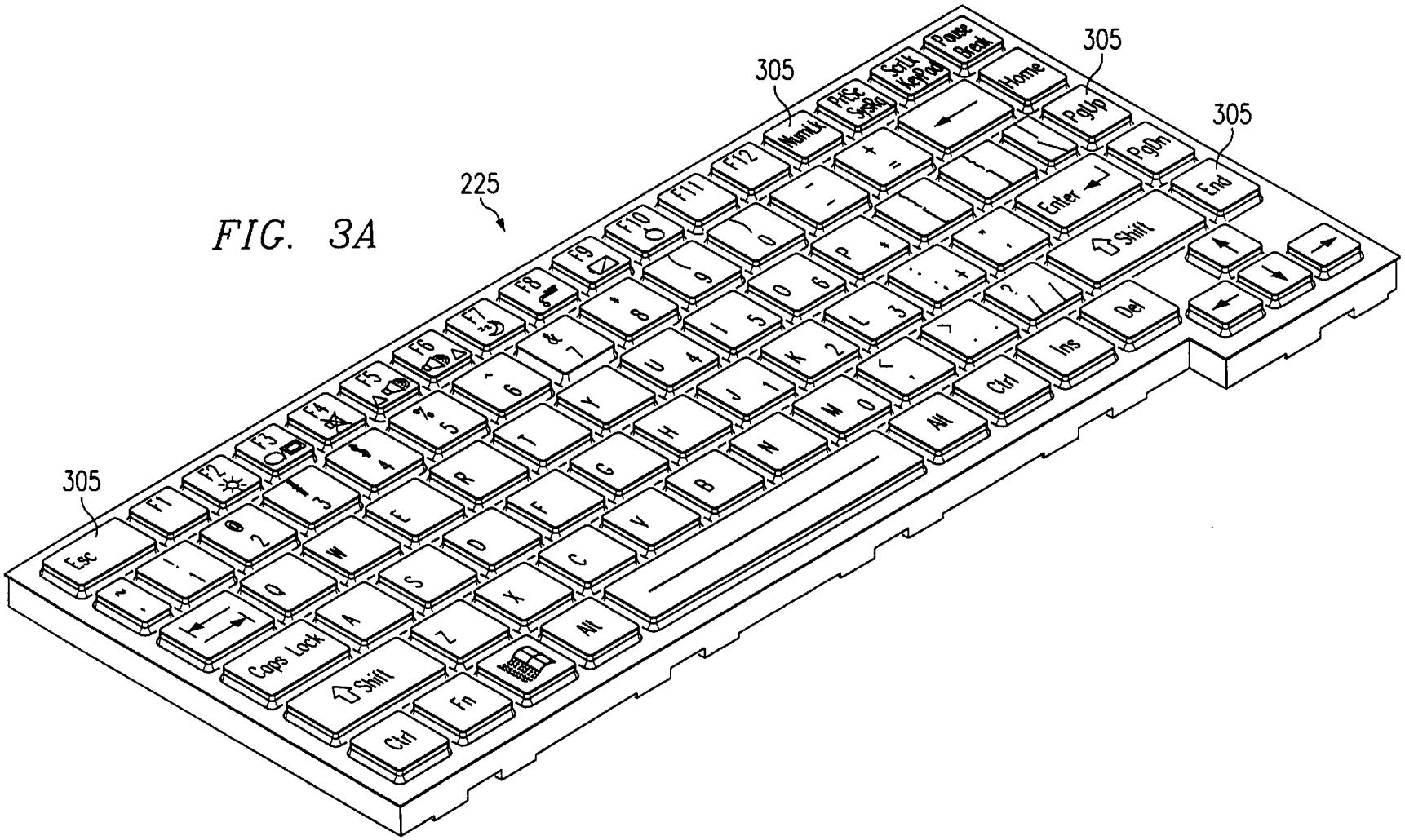
FIG. 3A shows a diagram of an elastomeric keypad.

FIG. 3A shows an elastomeric keypad 225 according to the present invention. The elastomeric keypad is comprised of a plurality of keys 305. The elastomeric keypad 225 can be a standard sized notebook computer keypad. The elastomeric keypad 225 begins as a clear elastomeric keypad made from a standard mold. The clear elastomeric keypad can be painted white and then painted black. Finally, the black paint may be etched off to reveal the white paint on each of the keys 305 so that a particular character is depicted.

Figure 3B:
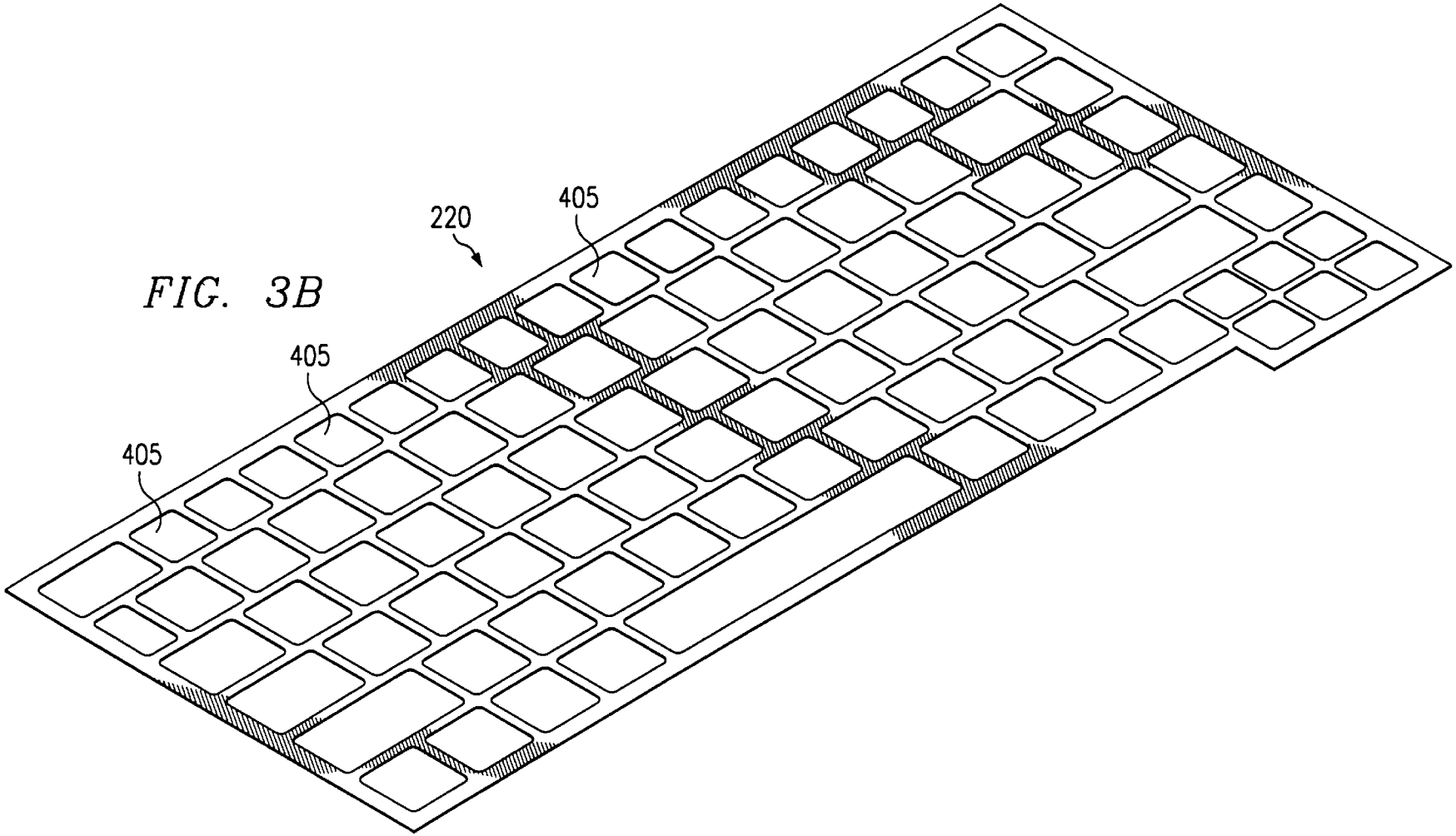
FIG. 3B shows a diagram of a spacer layer.

FIG. 3B shows a spacer layer 220 according to the present invention. The spacer layer 220 may be made from a material such as mylar. The spacer layer 220 has several holes 405 which coincide with and are shaped to fit the keys 305 of the elastomeric keypad 225. The spacer layer 220 is mounted on a top side of the first membrane switch matrix interconnect layer 215 and to a bottom side of the elastomeric keypad 225, thus separating the elastomeric keypad 225 from the first membrane switch matrix interconnect layer 215.

Figure 3C:
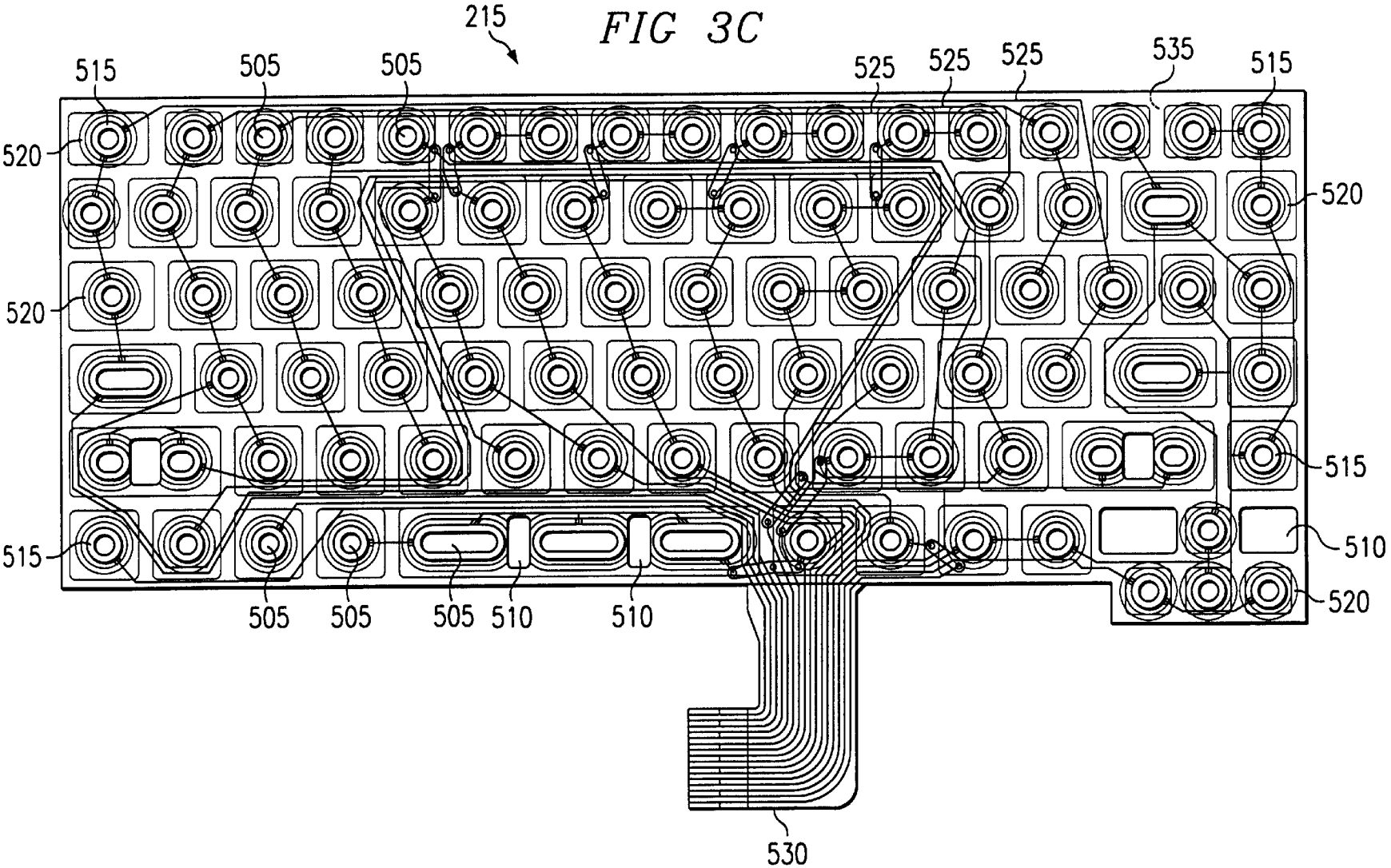
FIG. 3C shows a diagram of a first membrane switch matrix interconnect layer.

FIG. 3C shows the first membrane switch matrix interconnect layer 215 of FIG. 2 in greater detail. The first membrane switch matrix interconnect layer 215 has numerous holes 505 which coincide with the keys 305 of the elastomeric keypad 225 and the electrical components 710 located on a top side of the printed circuit board 205. the first membrane switch matrix interconnect layer 215 also has several conductive contacts 515, several circular raised spacers 520 located on a bottom side 535 of the first membrane switch matrix interconnect layer 215, numerous electrical nets 525 connecting the conductive contacts 515, and an electrical connector 530 which connects the nets 525 to a computer. The first membrane switch matrix interconnect layer 215 is mounted between the spacer layer 220 and the second membrane switch matrix interconnect layer 210. The spacer layer 220 is on a top side and the second membrane switch matrix interconnect layer 210 is on a bottom side of the first membrane switch matrix interconnect layer 215. The circular raised spacers 520 separate the conductive contacts 515 of the first membrane switch matrix interconnect layer 215 from the conductive contacts 615 of the second membrane switch matrix interconnect layer 210.

Figure 3D:
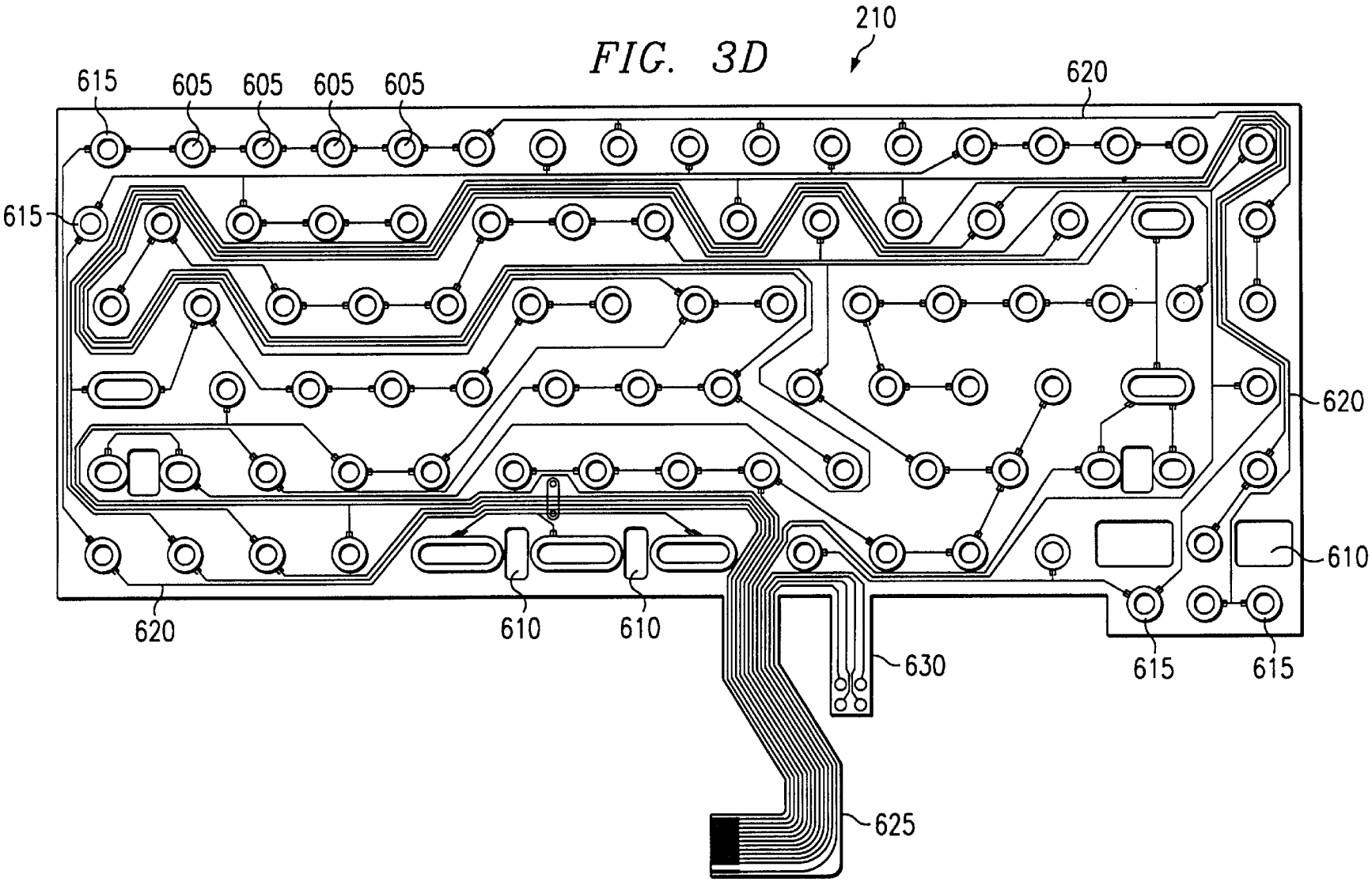
FIG. 3D shows a diagram of a second membrane switch matrix interconnect layer.

FIG. 3D shows a second membrane switch matrix interconnect layer 210 according to the present invention. The second membrane switch matrix interconnect layer 210 has numerous holes 605 which coincide with the keys 305 of the elastomeric keypad 225 and the electrical components 710 located on a top side of the printed circuit board 205. The second membrane switch matrix interconnect layer 210 also has several conductive contacts 615, numerous electrical nets 620 electrically connecting the plurality of conductive contacts 615, and two electrical connectors 625 and 630 which connect the electrical nets 620 to a computer. The second membrane switch matrix interconnect layer 210 is mounted between the back-lighting printed circuit board 205 and the first membrane switch matrix interconnect layer 215.

Figure 3E:
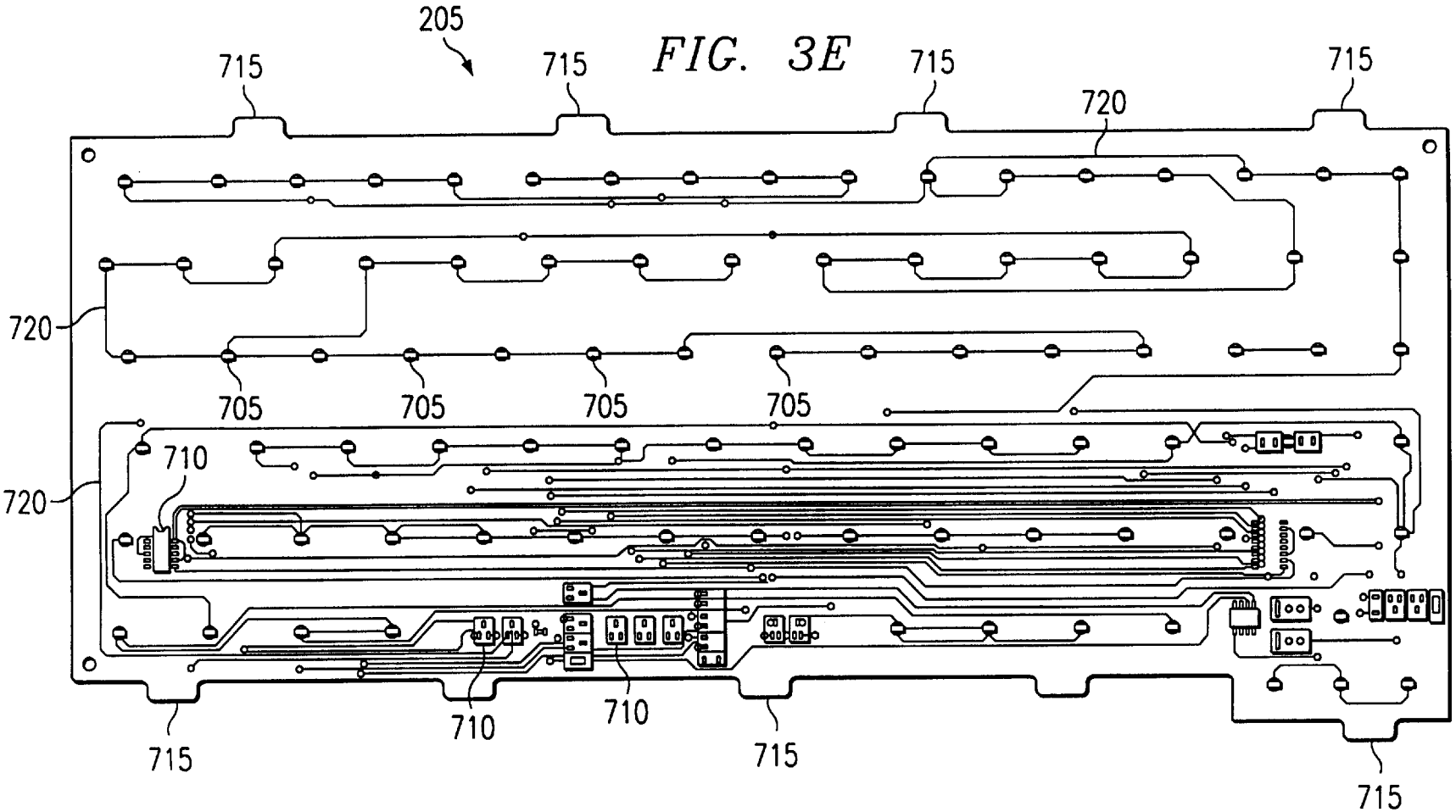
FIG. 3E shows a diagram of a printed circuit board.

FIG. 3E shows a printed circuit board 205 according to the present invention. The printed circuit board 205 has numerous light emitting diodes 705 which coincide with the positioning of the keys 305 of the elastomeric keypad 225, several electrical components 710 located on a top side of the printed circuit board 205, and several tabs 715 used to mount the keyboard apparatus 200 in a computer. The electrical components 710, and electrical connector which make up the control circuit control 700 the current draw and power the light emitting diodes 705 located on a top side 714 of the printed circuit board 205. The light emitting diodes 705 illuminate the keys 305 of the elastomeric keypad 225.

The printed circuit board 205 serves as the base of the keyboard apparatus 200. The tabs 715 located on the printed circuit board 205 are used to mount the keyboard apparatus 200 in a computer. This technical advantage is made possible since all of the electrical components 710 of the control circuit are located on a top side of the printed circuit board 205. The computer provides power to the control circuit of the keyboard apparatus 200 and lights the plurality of light emitting diodes 705. Once the light emitting diodes 705 are lit, the keys 305 of the elastomeric keypad 225 are illuminated. Since the light emitting diodes and the electrical components are mounted on a top side of the printed circuit board, the keyboard apparatus may now be mounted in a standard notebook computer as well as other type computers.

The electrical connectors 530, 625 and 630 of the first and second membrane switch matrix interconnect layers, 215 and 210, may be electrically connected to a standard notebook computer as well as other computers. When a user depresses a key 305 of the elastomeric keypad 225, the conductive contacts 515 and 615 of the first and second membrane switch matrix interconnect layers come in contact with each other and send electrical signals containing X and Y coordinates to a computer through the electrical connectors 530 and 625 respectively. The X and Y coordinates provide the computer with the information needed to determine which of the keys 305 have been depressed. The electrical connector 630 is electrically connected to the control circuit of the printed circuit board 205. The electrical connector 630 is electrically connected to a computer and provides power to the control circuit.

In summary, the elastomeric keyboard incorporating a novel interconnect and back-lighting architecture of the present invention includes a printed circuit board and a novel multi-layer membrane switch matrix interconnect structure. The printed circuit board contains a control circuit for powering and controlling the back-lighting of the elastomeric keyboard. The electrical components which make up the control circuit are mounted on a top side of the printed circuit board. The multi-layer switch matrix interconnect structure contains multiple holes arranged to coincide with the components of said control circuit. The multi-layer switch matrix interconnect structure also contains a number of electrical connectors, a number of conductive contacts, and a number of electrical nets for electrically connecting the conductive contacts to each other and to the electrical connectors.

Although the present invention has been described in detail, it should be understood that various changes, substitutions and alterations can be made hereto without departing from the spirit and scope of the invention as described by the appended claims.

What is claimed is:

1. A keyboard apparatus comprising:

a printed circuit board comprising:

a control circuit operable to power and control back-lighting of said keyboard apparatus, wherein electrical components of said control circuit are mounted on a top side of said printed circuit board; and a multi-layer membrane switch matrix interconnect structure comprising:

a plurality of holes arranged to coincide with components of said control circuit;

a plurality of electrical connectors;

a plurality of conductive contacts; and a plurality of electrical nets for electrically connecting said plurality of conductive contacts to each other and to the plurality of electrical connectors, wherein said multi-layer membrane switch matrix interconnect structure sends an electrical signal to said plurality of electrical connectors when any of said plurality of keys from said elastomeric keypad is depressed causing at least one of said plurality of conductive contacts of said first membrane switch matrix interconnect layer to come in contact with at least one of said plurality of conductive contacts of said second membrane switch matrix interconnect layer.

2. The keyboard apparatus of claim 1, further comprising:

an elastomeric keypad comprising a plurality of keys; and said printed circuit board further comprising:

a plurality of light emitting diodes mounted on a top side of said printed circuit board operable to illuminate said plurality of keys of said elastomeric keypad, said light emitting diodes arranged so they coincide with said plurality of holes of said multi-layer membrane switch matrix interconnect structure.

3. The keyboard apparatus of claim 1, wherein said multi-layer membrane switch matrix interconnect structure is mounted on said printed circuit board and said elastomeric keypad is mounted on said multi-layer membrane switch matrix interconnect structure.

4. The keyboard apparatus of claim 1, wherein said printed circuit board contains a plurality of tabs for securely mounting said keyboard apparatus in a standard notebook computer.

5. A keyboard apparatus comprising:

a printed circuit board comprising:

a control circuit operable to power and control the back-lighting of said keyboard apparatus, wherein electrical components of said control circuit are mounted on a top side of said printed circuit board; and a multi-layer membrane switch matrix interconnect structure comprising:

a plurality of holes arranged to coincide with components of said control circuit;

a plurality of electrical connectors;

a plurality of conductive contacts; and a plurality of electrical nets for electrically connecting said plurality of conductive contacts to each other and to the plurality of electrical connectors;

a spacer layer;

a first membrane switch matrix interconnect layer comprising:

a portion of said plurality of holes arranged to coincide with components of said control circuit;

a portion of said plurality of electrical connectors;

a portion of said plurality of conductive contacts; and a portion of said plurality of electrical nets for electrically connecting said portion of said plurality of conductive contacts to each other and to the portion of said plurality of electrical connectors; and a second membrane switch matrix interconnect layer comprising:

a remainder of said plurality of holes arranged to coincide with components of said control circuit;

a remainder of said plurality of electrical connectors;

a remainder of said plurality of conductive contacts; and a remainder of said plurality of electrical nets for electrically connecting said remainder of said plurality of conductive contacts to each other and to the remainder of said plurality of electrical connectors.

6. The keyboard apparatus of claim 5, wherein said first and second membrane switch matrix interconnect layers are separated by circular raised spacers located on a bottom side of said first membrane switch matrix interconnect layer and said spacer layer separates said first membrane switch matrix interconnect layer and said elastomeric keypad.

7. A multi-layer membrane switch matrix interconnect structure comprising:

a plurality of holes arranged to coincide with components of a control circuit located on a printed circuit board;

a plurality of electrical connectors;

a plurality of conductive contacts; and a plurality of electrical nets for electrically connecting said plurality of conductive contacts to each other and to the plurality of electrical connectors;

a space layer;

a first membrane switch matrix interconnect layer comprising;

a portion of said plurality of holes arranged to coincide with components of said control circuit;

a portion of said plurality of electrical connectors;

a portion of said plurality of conductive contacts; and a portion of said plurality of electrical nets for electrically connecting said portion of said plurality of conductive contacts to each other and to the portion of said plurality of electrical connectors; and a second membrane switch matrix interconnect layer comprising:

a remainder of said plurality of holes arranged to coincide with components of said control circuit;

a remainder of said plurality of electrical connectors;

a remainder of said plurality of conductive contacts; and a remainder of said plurality of electrical nets for electrically connecting said remainder of said plurality of conductive contacts to each other and to the remainder of said plurality of electrical connectors.

8. The multi-layer membrane switch matrix interconnect structure of claim 7, wherein said multi-layer membrane switch matrix interconnect structure is electrically connected to a keyboard apparatus and said control circuit.

9. The keyboard apparatus of claim 8, wherein said keyboard apparatus has an elastomeric keypad overlay.

10. The printed circuit board of claim 9, wherein a plurality of light emitting diodes are mounted on a top side of said printed circuit board, said plurality of light emitting diodes operable to illuminate said plurality of keys of said elastomeric keypad.

11. The multi-layer membrane switch matrix interconnect structure of claim 7, wherein said first and second membrane switch matrix interconnect layers are separated by circular raised spacers located on a bottom side of said first membrane switch matrix interconnect layer and said spacer layer separates said first membrane switch matrix interconnect layer and said elastomeric keypad.

12. The printed circuit board of claim 7, wherein said printed circuit board contains a plurality of tabs for securely mounting said keyboard apparatus in a standard notebook computer.

13. A method of manufacturing a keyboard apparatus comprising the steps of:

forming a multi-layer membrane switch matrix interconnect structure, wherein said multi-layer membrane switch matrix interconnect structure comprises:

a plurality of holes arranged to coincide with components of said control circuit;

a plurality of electrical connectors;

a plurality of conductive contacts; and a plurality of electrical nets for electrically connecting said plurality of conductive contacts to each other and to said plurality of electrical connectors; a spacer layer;

a first membrane switch matrix interconnet layer comprising:

a portion of said plurality of holes arranged to coincide with components of said control circuit;

a portion of said plurality of electrical connectors;

a portion of said plurality of conductive contacts; and a portion of said plurality of electrical nets for electrically connecting said portion of said plurality of conductive contacts to each other and to the portion of said plurality of electrical connectors; and a second membrane switch matrix interconnect layer comprising:

a remainder of said plurality of holes arranged to coincide with components of said control circuit;

a remainder of said plurality of electrical connectors;

a remainder of said plurality of electrical nets for electrically connecting said remainder of said plurality of conductive contacts to each other and to the remainder of said plurality of electrical connectors, forming a printed circuit board, wherein said printed circuit board comprises:

a control circuit operable to power and control the back-lighting of said keyboard apparatus, wherein electrical components of said control circuit are mounted on a top side of said printed circuit board; and mounting said multi-layer membrane switch matrix interconnect structure on said printed circuit board.

14. The method of manufacturing said keyboard apparatus of claim 13, further comprising the steps of mounting an elastomeric keypad on said multi-layer membrane switch matrix interconnect structure, said elastomeric keypad comprising a plurality of keys.

15. The method of manufacturing said keyboard apparatus of claim 13, further comprising the step of mounting a plurality of light emitting diodes on a top side of said printed circuit board, said plurality of light emitting diodes operable to illuminate said plurality of keys of said elastomeric keypad.

16. The method of manufacturing said keyboard apparatus of claim 13, wherein said multi-layer membrane switch matrix interconnect structure is manufactured by:

mounting said first membrane switch matrix interconnect layer on said second membrane switch matrix interconnect layer; and mounting said spacer layer on said first membrane switch matrix interconnect layer.

17. The printed circuit board of claim 13 further comprising a plurality of light emitting diodes mounted on a top side of said printed circuit board operable to illuminate said plurality of keys of said elastomeric keypad, said light emitting diodes arranged so they coincide with said plurality of holes of said multi-layer membrane switch matrix interconnect structure.

* * * * *